United States Patent [19]

Maebo et al.

[11] Patent Number: 5,020,451

[45] Date of Patent: Jun. 4, 1991

[54] FLUIDIZED-BED COMBUSTION FURNACE

[75] Inventors: Kunji Maebo, Kasukabe; Shigeru Hirabayashi, Kure, both of Japan

[73] Assignee: Ishikawajima-Harima Heavy Industries Co., Ltd., Tokyo, Japan

[21] Appl. No.: 592,258

[22] Filed: Oct. 3, 1990

[30] Foreign Application Priority Data

Oct. 5, 1989 [JP] Japan ..... 1-260918
Nov. 30, 1989 [JP] Japan ..... 1-311750

[51] Int. Cl.[5] ..... F23N 5/18

[52] U.S. Cl. ..... 110/189; 110/190; 110/245

[58] Field of Search ..... 110/189, 346, 190, 245, 110/188; 431/7, 170; 165/104.16; 422/189

[56] References Cited

U.S. PATENT DOCUMENTS 4,744,312 5/1988 Narisoko et al. ..... 110/245
4,870,910 10/1989 Wright et al. ..... 110/190
4,962,711 10/1990 Yamauchi et al. ..... 110/245 X

FOREIGN PATENT DOCUMENTS 0162313 12/1981 Japan ..... 110/190
0001913 1/1984 Japan ..... 110/189

*Primary Examiner*—Edward G. Favors
*Attorney, Agent, or Firm*—Oblon, Spivak, McClelland, Maier & Neustadt

[57] ABSTRACT

A fluidized-bed incineration system is disclosed wherein complete combustion of fluctuating furnace charge is achieved through the use of an invented system that includes a feedback control apparatus to regulate the variable quantities of air required for treating fluctuating volumes of products of combustion processes; the combustion control is triggered by a feedback apparatus incorporating the computed measurements of radiative energy or furnace pressure in combination with dynamic oxygen measurements.

4 Claims, 4 Drawing Sheets

FLUIDIZED-BED COMBUSTION FURNACE

FIELD OF THE INVENTION

The present invention relates to a fluidized-bed incineration system, comprising a fluidized-bed furnace and a control apparatus for use in disposal of waste materials, such as municipal wastes.

A fluidized-bed incineration furnace is an apparatus for disposal of substantially combustible waste materials, whose furnace bed is made of particulate materials, such as sand particles. These particles can be held in suspension (i.e. fluidized) by a blast of air blown through a series of holes in the blow pipes laid parallel to the bed-bottom. The waste materials undergo drying, thermal decomposition and combustion in the gaseous stream. This phase of combustion in fluidized-bed furnace is called first-stage combustion. The combustible gases generated in the first-stage combustion are further burned with the addition of supplementary air. This phase is called second-stage combustion. The flue gas, a mixture of the products of combustion from the two-stage combustion process, is passed through a heat exchanger, through a dust collector, a stack and is ultimately discharged into the atmosphere.

On occasion, a sudden change in the normal combustion condition may occur when a large volume or high calorific wastes are introduced into the furnace. This situation causes a sudden generation of excess flue gases, leading to a temporary unbalance between the flue gas and the supplementary air normally required for complete combustion. Such incomplete combustion of flue gases in the second-stage combustion results in releasing harmful unreacted flue gases and particulate materials into the atmosphere, causing possible environmental pollution.

To prevent such events, it is a general practice at present to monitor oxygen concentration in the flue gas line to guide in determining the amount of supplementary air required for complete combustion.

However, the traditional control techniques are based on the feedback signals from the sensors located distantly from the site of combustion, causing a time delay in activating the supplementary air supply. It is clear that a corrective action should be timed closely with the occurrence of sudden imbalance in the furnace load. Another problem which causes a delayed action is the response time of the instrument for the analysis of oxygen concentration, which must be completed before appropriate signals can be transmitted to the actuator to increase the flow of supplementary air to the second-stage combustion region. For these reasons, the present art of fluidized-bed control is insufficient to regulate the emissions of harmful gaseous and particulate matter generated by a sudden imbalance in the furnace load, caused by an introduction of a large quantity or size of furnace charge.

SUMMARY OF THE INVENTION

Therefore, it is an object of the present invention to provide a system of non-polluting operation of a fluidized-bed furnace wherein an efficient combustion process is promoted by closely coordinating the first- and second-stage combustion processes.

Said objective is attained by direct monitoring of the combustion conditions of the furnace and by correcting the response-time delay to changes in the oxygen concentration in the flue gas stream.

It is yet another object of the present invention to supply supplementary air quickly, in response to dynamic demand requirements of the fluidized furnace, to correct an imbalance in the combustion process by the timely detection of combustion conditions.

It is still another object of the present invention to provide a system to quickly and accurately regulate the supply of supplementary air, in response to the information supplied by direct monitoring of the combustion of the fluidized furnace.

It was found after various analysis of process data that the above objectives are realized by direct monitoring of the physical parameters associated with the combustion processes within the furnace, for example, measurements of the radiative energy or furnace pressure.

In other words, one aspect of this invention concerns a system of efficient control of the combustion of the fluidized-bed furnace wherein the combustion process comprises:

(a) the first-stage combustion of furnace charges taking place in a bed of fluid-like environment, created by the action of a mixture of the primary air blowing through a series of pipes located at the bottom of said furnace; and (b) the products of combustion generated from the first-stage combustion are mixed with supplementary air to further treat the flue gas in the second-stage combustion process wherein (c) a feedback control of the volume of said supplementary air is achieved according to the information generated from the combustion process parameters within the furnace.

It is still another aspect of this invention to furnish a fluidized-bed incineration furnace with the control system mentioned above, including monitoring of the process parameters of combustion with the use of sensors located on the furnace itself to directly monitor said parameters such as, radiative energy or furnace pressures, so that quick and accurate response can be made to the volume requirements of the supplementary air in the second-stage combustion.

It is, therefore, the concluding aspect of this invention that an efficient utilization of the overall system, as described above, enables substantially pollution-free operation of the fluidized-bed furnace to be carried out even if the furnace loading is suddenly altered because of an introduction of a large volume or high calorific value charges, and the consequent temporary generation of a large quantity of excess flue gas.

BRIEF DESCRIPTION OF THE DRAWINGS

FIG. 1 is a schematic representation of the overall arrangement of the invented fluidized-bed incineration system. FIG. 2 is a simplified representation of the control apparatus. FIG. 3 is a graph showing the time-dependent variations of the values of radiation pyrometer and of the oxygen concentration monitor.

DETAILED DESCRIPTION OF THE PREFERRED EMBODIMENT

The preferred embodiments of the present invention are explained with reference to the figures presented.

Fluidized-bed System

Figure 1:
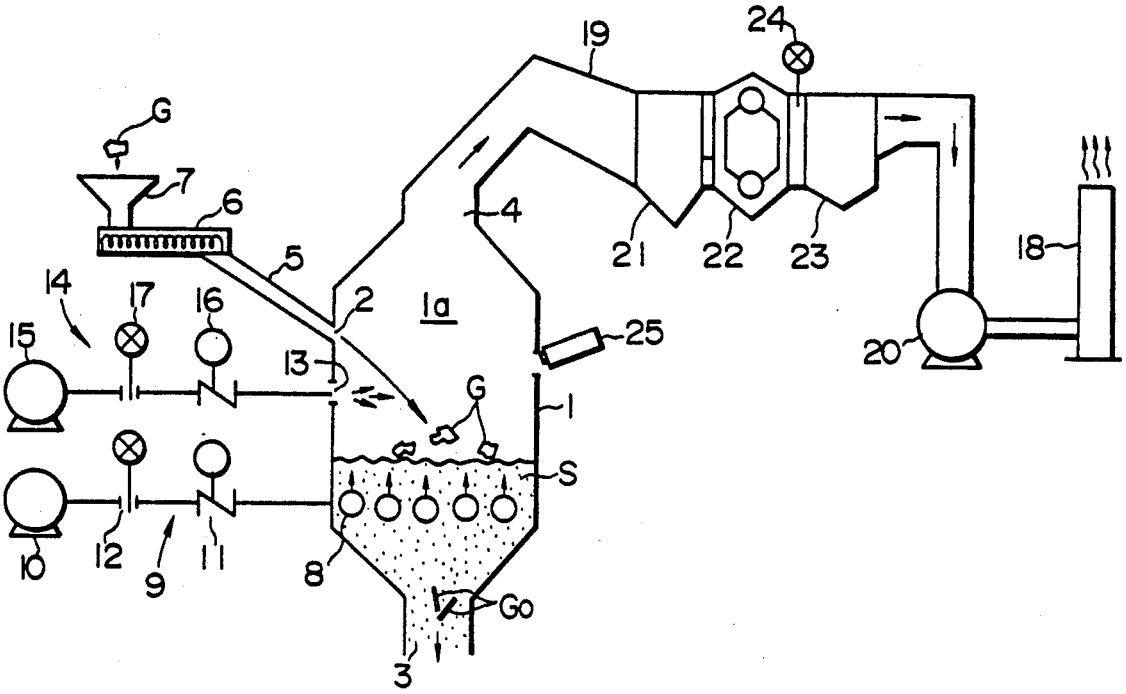
FIGS. 1 to 3 show various aspects of the preferred embodiments of this invention.

FIG. 1 is an overall schematic representation of a fluidized-bed incineration system that will enable substantially pollution-free operation of a waste disposal system.

In FIG. 1, a furnace 1 contains floatable bed medium S, such as sand, in the interior 1*a* of the furnace 1. This medium S is maintained at elevated temperatures during the normal operation by the heat of combustion of the furnace charge G.

The furnace 1 is equipped with a loading port 2, through which the charge G is introduced onto the fluidized bed medium S; a discharge port 3, through which non-combustible residue materials $G_o$ are discharged; and an exhaust opening 4 through which the gaseous products of combustion can be vented.

The loading port 2 is equipped with a shoot 5 to which is attached a loading apparatus comprised of a screw conveyor 6 and a hopper 7 to direct the incoming charge G onto the conveyor 6. The charge G is transported further by the conveyor 6 into the interior 1*a* of the furnace 1 through the shoot 5, and which charge G is ultimately led onto the surface of the fluidized bed S.

At the bottom of the furnace interior la, are present several (five in this preferred embodiment) parallel blow pipes 8 which are almost completely covered by the bed medium S. When gaseous fuel is blown into the pipes, through the air supply device 9, and discharged into the furnace interior 1*a* through the blow holes in the pipes, the particles of the bed medium become suspended, i.e. fluidized, to form a fluidized-bed, in the gas stream. The gas stream produces an effect of suspending the charge G in the bed medium S. The action of the burning fuel gas results in the drying, heat decomposition and combustion of the charged material G. This process is termed first-stage combustion and the air required for this operation is termed first-stage combustion air (hereinafter, simply as FS-air).

Combustion Processes and Air Supply Requirements

The FS-air supply device 9 comprises a FS-air supply fan 10, a damper 11 associated thereof to adjust the air flow, a signal generator 12 to indicate the FS-air flow volume into the furnace interior 1*a*. The volume of air supplied by FS-air supply device 9 is affected by several factors including the base value of the air volume required to create a gas column to suspend the bed medium, the quality of the bed media (in the present invention, sand quality), and the temperature of the fluid bed S.

The furnace 1 is also equipped with an opening 13 for the introduction of the second-stage combustion air (hereafter simply as SS-air), from a SS-air supply device 14, into the interior of the furnace la at a location above the fluidized bed S so as to react with the gaseous products of combustion generated in the first-stage combustion process.

The SS-air supply device 14 comprises, similar to FS-air supply device 9, a SS-air supply fan 15, a damper 16 to regulate the air flow and a flow meter 17 to indicate the SS-air flow volume into the furnace interior 1*a*.

It should be noted that although there is only one SS-air supply device shown in FIG. 1, in actual practice, there can be present a plurality of independently controllable units around the periphery of the furnace to provide optimum combustion efficiency.

Removal of Flue Gases

The exhaust opening 4 is attached to an exhaust removal line 19, equipped with an exhaust fan 20, which transports the gaseous products of combustion, from the furnace interior 1*a* to the entrance to the chimney 18, to be vented to the atmosphere. In between said opening 4 and the chimney 18, said line 19 is further equipped with, beginning with a dust settling facility 21, a heat recovery boiler 22 and an electrostatic dust precipitator 23.

Air Supply Control Device

Figure 2:
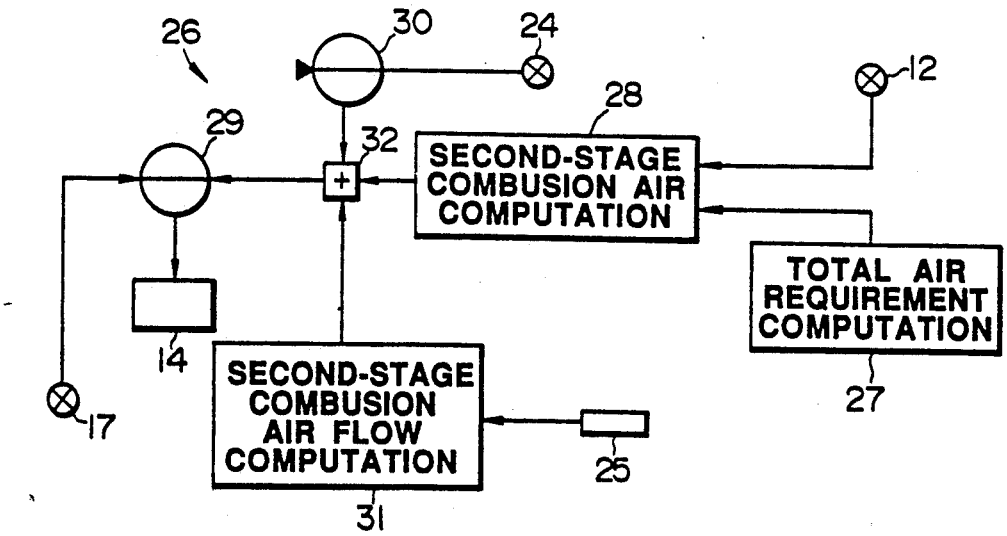

The control of the supplementary air supply is carried out according to the information obtained from a feedback arrangement. Shown in FIG. 2 are two basic elements of such a feedback arrangement utilized in the preferred embodiments.

In an example of the preferred embodiments, an oxygen concentration analyzer 24 (hereinafter termed a oxygen meter), located at the entrance to the electric precipitator 23, and a radiation pyrometer 25, located on the furnace 1, are connected to a second-stage combustion control apparatus 26 to provide a information feedback arrangement, between the oxygen meter 24 and the radiation pyrometer 25, so as to enable said apparatus 26 to adjust the supply of SS-air to respond appropriately to the demands of the changing furnace load.

The operation of the second-stage combustion control apparatus 26 is explained with reference to FIG. 2;

1. a total-air-requirement computing device 27 (hereinafter referred to as computing device 27) calculates an initial operational value of the total air-volume requirement, based on the sum of the values for both FS-air supply device 9 and SS-air supply device 14;

2. a SS-air computing device 28 receives both said value for the total air flow requirement and the initial FS-air flow value from a FS-air flow meter 12, and calculates a difference between said total air flow value and the current value of the FS-air flow.

3. a SS-air flow controller 29 is given said difference (to be the current air requirement for the second-stage combustion process) and operates the SS-air supply device 14 to maintain the SS-air flow, with feed back signal from the SS-air flow meter 17.

In addition to the above basic operation of the furnace system;

4. said SS-air flow controller 29 responds to varying demands for oxygen in the system as dictated by the signal from an adding computer 32;

4.1. which computer 32 receives signals from the oxygen concentration controller 30, and compares the preset value with the signal from oxygen meter 24, located at the entrance to the electric precipitator 23, as necessary; additionally, 4.2. which computer 32 receives signals from said SS-air computing device 28 and from oxygen controller 30 &o activate the SS-air supply device 14 to provide the required amount of oxygen (as contained in air) to the furnace system to satisfy the new combustion condition.

The oxygen concentration in the flue gas is a good indicator of the state of combustion in the system because a low oxygen reading indicates incomplete combustion while a high oxygen reading indicates excess SS-air supply; and therefore by following the procedure described in the above preferred embodiment, it is possible to operate the furnace system at it optimum efficiency.

In addition to the advanced operational mode of the furnace described so far, the feedback arrangement, by means of SS-air flow correcting computer 31 acting on the signals from the radiation pyrometer 25, operates as follows:

5. said SS-air flow controller 29 responds to a signal from said SS-air computing device 28, which receives signals from:

5.1 the SS-air flow correcting computer 31, which calculates the current air flow requirement based on the current input of said radiation pyrometer 25, and 5.2 the oxygen concentration controller 30, and 5.3 the SS-air computing device 28, to calculate a new signal, based on the input from all of the foregoing, and forwarded it preferentially to the SS-air flow controller 29 to activate the SS-air supply device 14 to meet the new (or unchanging) need of the second-stage combustion process.

Although not shown in the figures, when it is necessary to supply SS-air from a plurality of secondary air supply openings, the SS-air supply device 14 can be adjusted to apportion the air to different openings. It is, furthermore, possible to control the air flow to said different openings automatically, by electrically connecting the SS-air supply device 14 directly to SS-air flow correcting computer 31.

The fluidized-bed incineration system and the method for the control thereof, as described in the preferred embodiments above, are able to minimize the generation of pollution-causing gaseous products of combustion resulting from the process of incomplete combustion caused by sudden fluctuations in the furnace loading. Such fluctuations are detected as a sudden rise in the furnace temperature by the radiation pyrometer 25, whose signals are processed by the second-stage combustion control apparatus 26 which quickly adjust SS-air supply device 14 to increase the air supply to second-stage combustion process.

Feedback Control Systems

Figure 3:
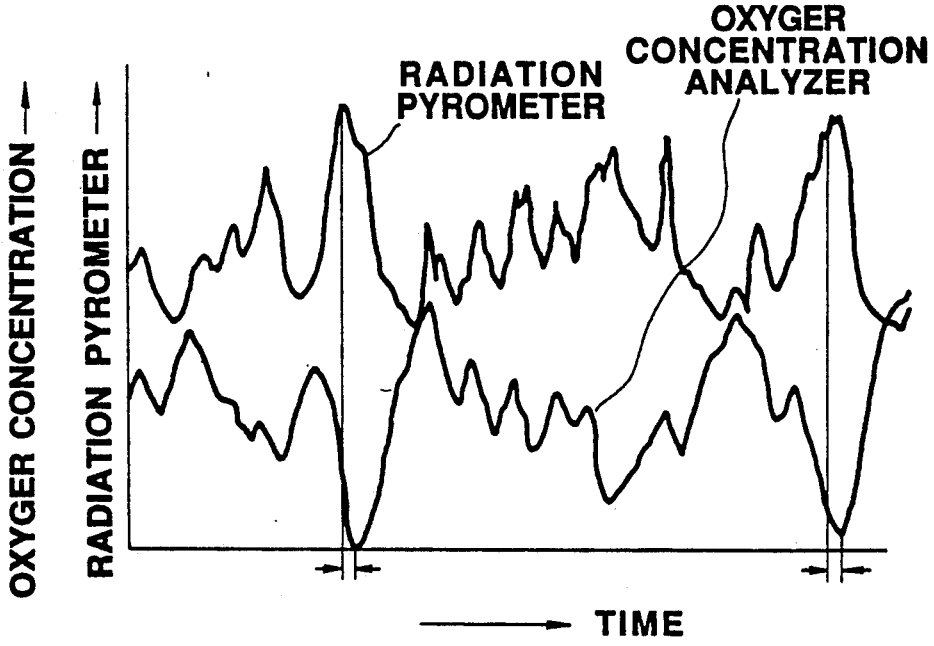

The radiation pyrometer 25 converts the radiative energy of combustion into temperature, which responds quickly to changes in the radiative energy within the furnace. FIG. 3 shows time-dependent variations within the furnace environment as detected by the radiation pyrometer 25 and by the oxygen meter 24, respectively. It can be seen in FIG. 3 that incomplete combustion is detected first by the radiation pyrometer 25 (as a rise in the furnace temperature), and a short time later (15 seconds), by the oxygen meter 24. This example demonstrates that it would be possible to prevent incomplete combustion substantially by adjusting the supply of SS-air quickly to respond to the generation of excess flue gas.

Next, the use of pressure as an indicator of the state of combustion within the furnace is described.

Figure 4:
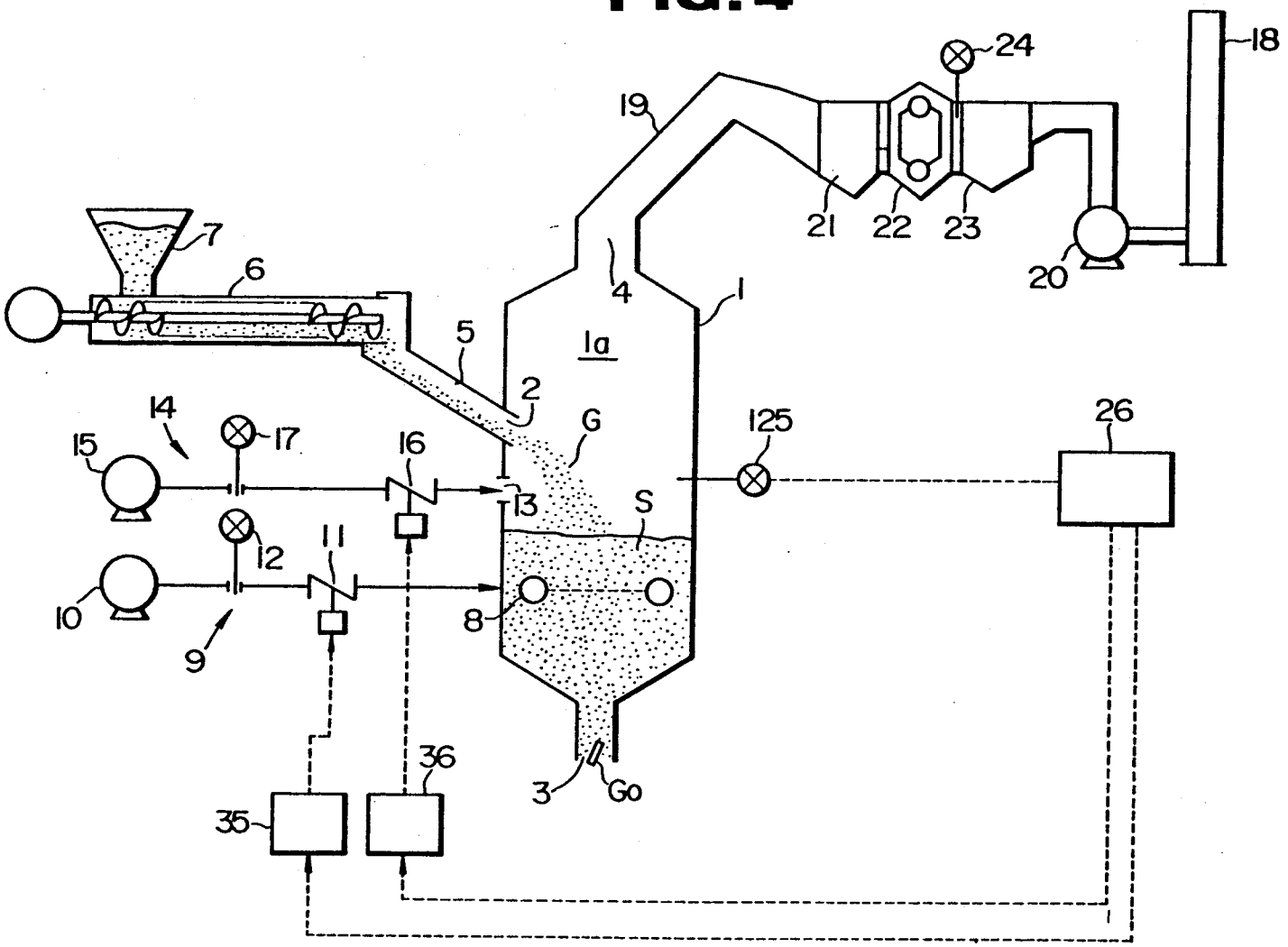
FIG. 4 is a schematic representation of the furnace system and its control apparatus.

FIG. 4 is a schematic diagram of the furnace and its control system used in a preferred embodiment of this invention.

The numbering scheme and the function of the various elements shown in FIG. 4 are identical to those shown in FIG. 1, and their explanations will not be repeated here. The principal difference in the concepts described by these figures is the replacement of the radiative energy with the furnace pressure as a controlling indicator of the state of combustion within the furnace.

In contrast to the previous example, this example of the preferred embodiments utilizes a pressure sensor 125, located on the furnace 1, to regulate the flow volume of SS-air by the second-stage combustion control apparatus 26 in conjunction with the oxygen meter 24.

Figure 5:
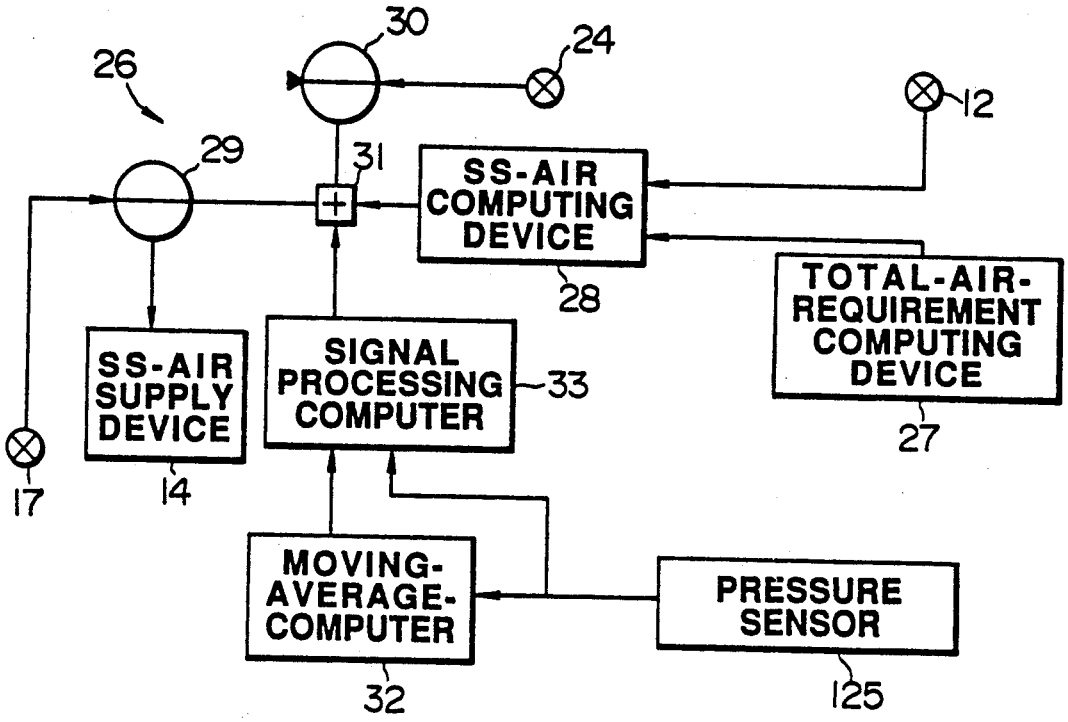
FIG. 5 shows the block diagram of the control methodology.
Figure 6:
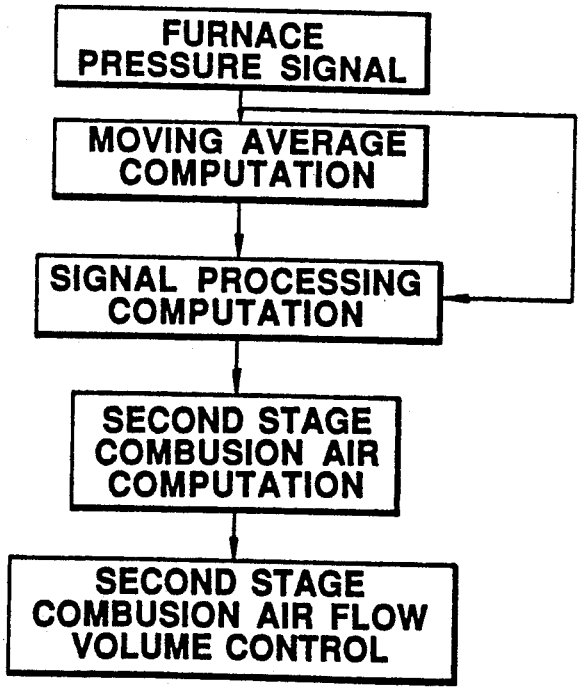
FIG. 6 shows the block diagram of the control logic.

The operation of the second-stage combustion control apparatus 26 is explained in reference to FIG. 5, in a simplified version of the detailed explanation offered earlier for the case of radiation pyrometer 25.

As before, the computing device 27 first determines an initial operational value of the total air volume requirement, to supply both FS-air supply device 9 and the SS-air supply device 14. The SS-air computing device 28 calculates the SS-air volume requirement as the difference between the initial total air volume requirement and the current air volume obtained from the FS-air flow meter 12. The SS-air flow controller 29 operates the SS-air supply device 14 so as to maintain the SS-air flow at the demanded value with a feedback signal from SS-air flow meter 17.

Furthermore, the status of the oxygen concentration in the flue gas is monitored with the oxygen meter 24, located at the entrance pathway 19 to the electric precipitator 23. The measured value of the oxygen concentration is entered into said oxygen concentration controller 30, and further combined in the adding computer 32 with the signal from SS-air computing device 28. The combined signal is used as a reference signal for the SS-air air flow controller 29, which controls the operation of the SS-air supply device 14.

The pressure signal from the furnace pressure sensor 125 is transmitted to a moving-average-computer 132, processed and sent to a signal processing computer 33. The signal processing computer 33 compares the averaged value from the moving-average-computer 132 with the current-value signal generated by pressure sensor 125, and calculates the degree of deviation between the two values. The processed signal is sent to the adding computer 32 to correct the reference signal to the SS-air flow controller 29 to activate the SS-air supply device 14.

In practice, when the furnace load is suddenly increased, the pressure of the interior of the furnace 1*a* increases correspondingly as a result of the generation of excess gaseous products of combustion. The high pressure values are compared with the moving-average-values, and only those values which exceed a certain set value are forwarded to the adding computer 32, which initiates the corrective action of the SS-air flow controller 29.

The control signal of the SS-air flow controller 29 is transmitted to SS-air volume regulator 36 to activate the damper 16 of the SS-air supply device 14 to regulate the air supply to the second-stage combustion process. The signals from the signal processing computer 33 can also be transmitted to the FS-air supply device 9 to activate the FS-air volume regulator 35 to vary the air volume supplied to the first-stage combustion region.

The pressure variation in the interior of the furnace 1*a* reflects closely the state of combustion thereof when the FS-air flow volume is kept constant. However, the relative relationship between the furnace pressure and the state of combustion is altered when the operating conditions are changed by, for example, the cessation of loading. Therefore, it is one of the features of this invention that the pressure signal is not used directly to regulate the SS-air flow but that it is used only as an integral parameter within the overall control of the second-stage combustion control apparatus 26.

Although not shown in the figures, when it is necessary to supply SS-air to a plurality of secondary air supply openings, the SS-air supply device 14 can be utilized to distribute the air to different openings. It is, furthermore, possible to control the air flow to a particular opening through signal processing computer 33 to drive the SS-air supply apparatus.

General Summary

The fluidized-bed incineration system and the method for the control thereof as described in the preferred embodiment above, are able to minimize the generation of pollution-causing gaseous products of combustion resulting from the process of incomplete combustion. Such fluctuations are caused by sudden changes in the operating condition, for example, a large volume or calorific value of furnace charge. Such an event is detected as a sudden rise in the furnace pressure, monitored with a furnace pressure measuring apparatus 125, whose signals are processed by the second-stage combustion control apparatus 26, which quickly adjust SS-air supply device 14 to prevent incomplete combustion in the second-stage combustion process.

It should be noted that although the preferred embodiment described above utilized a radiation pyrometer as an example of the techniques of measuring the thermal radiation energy generated within the furnace, but other thermal radiation measuring techniques, such as brightness meters and others, can also be adapted. Also, other systems of feedback controls in conjunction with the radiation pyrometer and the pressure sensors can also be used.

It is clear from the explanations provided that the present invention provides an efficient and effective control of incomplete combustion associated with the operation of fluidized-bed incinerators, caused by fluctuations in the furnace load, such as a temporary overload or an introduction of unusually high calorific furnace charge.

What is claimed is:

1. A means for providing a feedback control system of combustion processes in a fluidized-bed incinerator wherein a solid furnace charge is converted to gaseous products in two consecutive stages:

(a) first-stage combustion generating a mixture of gaseous and particulate products of combustion, and (b) second-stage combustion wherein said products of combustion are further treated with supplemental air;

wherein said control system regulates, (c) feedback signals from the radiative energy of the first-stage combustion process to provide timely control of the volume of supplemental air to be supplied to the secondary combustion region.

2. A means for controlling the combustion processes of a fluidized-bed incinerator as in claim 1 wherein said means for determining the radiative energy output is a radiation pyrometer, said pyrometer suitably located within the first-stage combustion region to provide appropriate feedback control of the supply of air to said secondary combustion region.

3. A means for providing a feedback control system of combustion processes taking place in a fluidized-bed incinerator wherein the solid furnace charge is converted to gaseous products in two consecutive stages:

(a) first-stage combustion generating a mixture of gaseous and particulate products of combustion, and (b) second-stage combustion wherein said products of combustion are further treated with supplemental air, wherein said control system regulates, (c) feed-back signals from pressure variations in the first-stage combustion process, to provide timely control of the volume of supplemental air to be supplied to the secondary combustion region.

4. A means for controlling the combustion processes of a fluidized-bed incinerator as in claim 3, wherein said means for determining the furnace pressure is a pressure sensor suitably located within the first-stage combustion region to provide appropriate feedback control of the supply of air to said secondary combustion region.

* * * * *